US011621112B2

(12) United States Patent
Hirukawa

(10) Patent No.: US 11,621,112 B2
(45) Date of Patent: Apr. 4, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 337 days.

(21) Appl. No.: 16/854,560

(22) Filed: Apr. 21, 2020

(65) Prior Publication Data

US 2020/0373053 A1 Nov. 26, 2020

(30) Foreign Application Priority Data

May 24, 2019 (JP) ..... JP2019-097636

(51) Int. Cl.
*H01F 41/04* (2006.01)
*H01F 17/00* (2006.01)

(52) U.S. Cl.
CPC ..... *H01F 17/0013* (2013.01); *H01F 41/04* (2013.01); *H01F 41/041* (2013.01); *H01F 2017/002* (2013.01)

(58) Field of Classification Search
CPC ..... H01F 17/00; H01F 41/04; H01F 17/0013; H01F 2017/002; H01F 41/041; H01F 27/28; H01F 27/2804; H01F 27/29; H01F 27/292; H01F 5/003; H01F 27/323
USPC ..... 361/117–119
See application file for complete search history.

(56) References Cited

U.S. PATENT DOCUMENTS 6,157,285 A 12/2000 Tokuda et al.
2012/0313743 A1* 12/2012 Kimura ..... H01F 17/0013 336/200
2017/0047160 A1* 2/2017 Kim ..... H01F 41/046
2017/0345552 A1 11/2017 Nakano et al.
(Continued)

FOREIGN PATENT DOCUMENTS

JP H09-129447 A 5/1997
JP H10-335143 A 12/1998
(Continued)

OTHER PUBLICATIONS

An Office Action; "Notice of Reasons for Refusal," mailed by the Japanese Patent Office dated Dec. 21, 2021, which corresponds to Japanese Patent Application No. 2019-097636 and is related to U.S. Appl. No. 16/854,560 with English language translation.

*Primary Examiner* — Danny Nguyen
(74) *Attorney, Agent, or Firm* — Studebaker & Brackett PC

(57) ABSTRACT

A multilayer coil component includes a multilayer body formed by stacking a plurality of insulating layers in a length direction and that has a built-in coil, and first and second outer electrodes that are electrically connected to the coil. The coil is formed by a plurality of coil conductors stacked in the length direction being electrically connected to each other. The first and second outer electrodes respectively cover parts of first and second end surfaces and parts of a first main surface. A stacking direction of the multilayer body and an axial direction of the coil are parallel to the first main surface. In a plan view from the stacking direction, a repeating shape of the coil conductors is a non-circular shape, and distances between the first main surface and the parts of the coil conductors that face the first main surface are not constant.

18 Claims, 7 Drawing Sheets

(56) References Cited

U.S. PATENT DOCUMENTS

| | | | | |
|---|---|---|---|---|
| 2018/0012696 | A1* | 1/2018 | Lee | H01F 17/0013 |
| 2018/0166206 | A1* | 6/2018 | Ueyama | H01F 17/0013 |
| 2019/0237239 | A1* | 8/2019 | Kato | H01F 27/292 |
| 2019/0333686 | A1* | 10/2019 | Kazuta | H01F 27/29 |

FOREIGN PATENT DOCUMENTS

| | | | |
|---|---|---|---|
| JP | H11-307344 | A | 11/1999 |
| JP | 2017-212372 | A | 11/2017 |
| JP | 2018-098368 | A | 6/2018 |

* cited by examiner

MULTILAYER COIL COMPONENT

CROSS-REFERENCE TO RELATED APPLICATION

This application claims benefit of priority to Japanese Patent Application No. 2019-097636, filed May 24, 2019, the entire content of which is incorporated herein by reference.

BACKGROUND

Technical Field

The present disclosure relates to a multilayer coil component.

Background Art

In response to the increasing communication speed and miniaturization of electronic devices in recent years, it is demanded that multilayer inductors have satisfactory radio-frequency characteristics in a high-frequency band (for example, a GHz band located at frequencies greater than or equal to 60 GHz). As an example of a multilayer coil component, Japanese Unexamined Patent Application Publication No. 09-129447 discloses a multilayer inductor in which the stacking direction of insulating members and the axial direction of the coil are parallel to the mounting surface of the multilayer inductor. In FIG. 2 of Japanese Unexamined Patent Application Publication No. 09-129447, a configuration is disclosed in which the coil conductors are ½ pattern coil conductors (pattern in which two coil conductors are stacked to form one turn of the coil) and the repeating shape of the coil is a rectangular shape.

In the multilayer inductor disclosed in Japanese Unexamined Patent Application Publication No. 09-129447, outer electrodes are formed by performing sputtering, vacuum deposition or the like on the two end portions of a multilayer body of the multilayer inductor. However, the multilayer inductor is thought to have poor mountability due to the outer electrodes not being disposed on the mounting surface of the multilayer inductor.

Accordingly, consideration has been given to providing the outer electrodes on the mounting surface in order to improve the mountability of the multilayer inductor. However, since stray capacitances are generated between the outer electrodes and the coil conductors when the outer electrodes are provided on the mounting surface, there is a risk that these stray capacitances will lead to deterioration of the radio-frequency characteristics of the multilayer inductor.

SUMMARY

Accordingly, the present disclosure provides a multilayer coil component that has excellent mountability and excellent radio-frequency characteristics.

A multilayer coil component according to a preferred embodiment of the present disclosure includes a multilayer body that is formed by stacking a plurality of insulating layers on top of one another in a length direction and that has a coil built into the inside thereof; and a first outer electrode and a second outer electrode that are electrically connected to the coil. The coil is formed by a plurality of coil conductors stacked in the length direction together with the insulating layers being electrically connected to each other.

The multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction. The first outer electrode extends along and covers part of the first end surface and part of the first main surface. The second outer electrode extends along and covers part of the second end surface and part of the first main surface. The first main surface is a mounting surface. A stacking direction of the multilayer body and an axial direction of the coil are parallel to the first main surface. In a plan view of a repeating shape of the coil conductors from the stacking direction, the repeating shape of the coil conductors is a non-circular shape and distances between the first main surface and parts of the coil conductors that face the first main surface are not constant.

According to the preferred embodiment of the present disclosure, a multilayer coil component can be provided that has excellent mountability and excellent radio-frequency characteristics.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following embodiment and the present disclosure can be applied with appropriate modifications within a range that does not alter the gist of the present disclosure. Combinations consisting of two or more desired configurations among the configurations described below are also included in the scope of the present disclosure.

Figure 1:
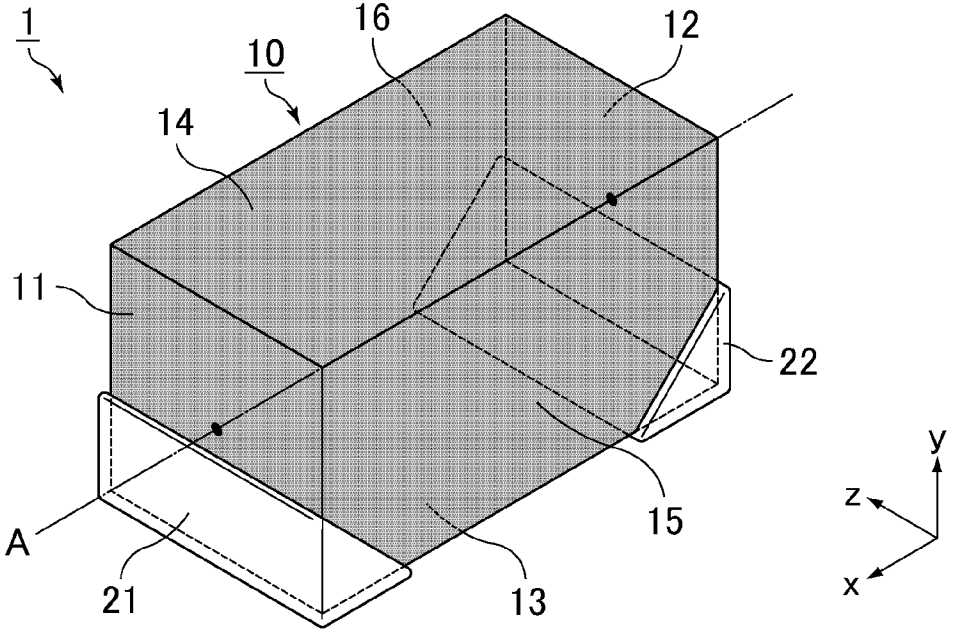
FIG. 1 is a perspective view schematically illustrating an example of a multilayer coil component according to an embodiment of the present disclosure.
Figure 2A:
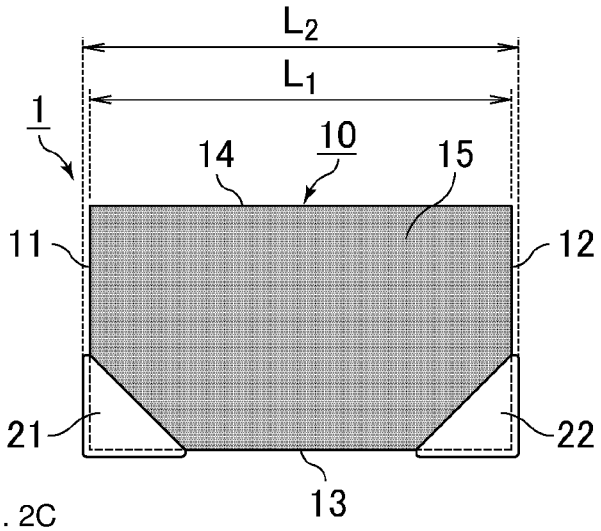
FIG. 2A is a side view of the multilayer coil component illustrated in FIG. 1.
Figure 2B:
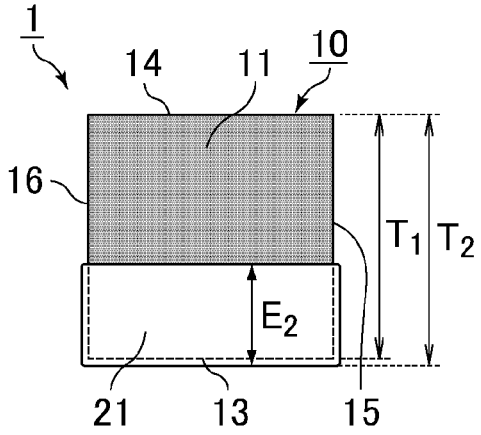
FIG. 2B is a front view of the multilayer coil component illustrated in FIG. 1.
Figure 2C:
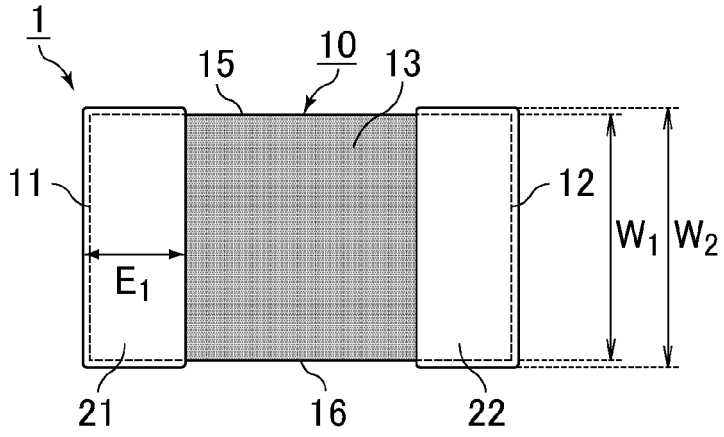
FIG. 2C is a bottom view of the multilayer coil component illustrated in FIG. 1.

FIG. 1 is a perspective view schematically illustrating an example of a multilayer coil component according to an embodiment of the present disclosure. FIG. 2A is a side view of the multilayer coil component illustrated in FIG. 1, FIG. 2B is a front view of the multilayer coil component illustrated in FIG. 1, and FIG. 2C is a bottom view of the multilayer coil component illustrated in FIG. 1.

A multilayer coil component 1 illustrated in FIGS. 1, 2A, 2B, and 2C includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another in a length direction and has a coil built into the inside thereof. The first outer electrode 21 and the second outer electrode 22 are electrically connected to the coil.

In the multilayer coil component 1 and the multilayer body 10 of the embodiment of the present disclosure, a length direction, a height direction, and a width direction are respectively an x direction, a y direction, and a z direction in FIG. 1. Here, the length direction (x direction), the height direction (y direction), and the width direction (z direction) are perpendicular to each other.

As illustrated in FIGS. 1, 2A, 2B, and 2C, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

As illustrated in FIG. 1, in the multilayer body 10, a coil axis A is assumed that is parallel to the length direction (x direction) and penetrates from the first end surface 11 to the second end surface 12. The direction in which the coil axis A extends is the axial direction of the coil that is built into the multilayer body 10. The axial direction of the coil and the stacking direction of the multilayer body 10 are parallel to the first main surface 13, which is a mounting surface.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, but does not cover a region of the first end surface 11 that includes the edge portion that intersects the second main surface 14. Therefore, the first end surface 11 is exposed in the region including the edge portion that intersects the second main surface 14. In addition, the first outer electrode 21 does not cover the second main surface 14.

In FIG. 2B, the height of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, the length of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13, but does not cover a region of the second end surface 12 that includes the edge portion that intersects the second main surface 14. Therefore, the second end surface 12 is exposed in the region including the edge portion that intersects the second main surface 14. In addition, the second outer electrode 22 does not cover the second main surface 14.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the first side surface 15 and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the first side surface 15 and part of the second side surface 16.

The first outer electrode 21 and the second outer electrode 22 are arranged in the manner described above, and therefore the first main surface 13 of the multilayer body 10 serves as a mounting surface when the multilayer coil component 1 is mounted on a substrate.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L_1$ in FIG. 2A) preferably lies in a range from 0.57 mm to 0.63 mm. In the case where the multilayer coil component 1 according to the embodiment of the present disclosure is the 0603 size, the width of the multilayer body 10 (length indicated by double-headed arrow $W_1$ in FIG. 2C) preferably lies in a range from 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range from 0.27 mm to 0.33 mm.

In the case where the multilayer coil component 1 according to the embodiment of the present disclosure is the 0603 size, the length of the multilayer coil component 1 (length indicated by double arrow L2 in FIG. 2A) preferably lies in a range from 0.57 mm to 0.63 mm. In the case where the multilayer coil component 1 according to the embodiment of the present disclosure is the 0603 size, the width of the multilayer coil component 1 (length indicated by double-headed arrow W2 in FIG. 2C) preferably lies in a range from 0.27 mm to 0.33 mm. In the case where the multilayer coil component 1 according to the embodiment of the present disclosure is the 0603 size, the height of the multilayer coil component 1 (length indicated by double-headed arrow T2 in FIG. 2B) preferably lies in a range from 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow $E_1$ in FIG. 2C) preferably lies in a range from 0.12 mm to 0.22 mm. Similarly, the length of the part of the second outer electrode 22 that covers the first main surface 13 of the multilayer body 10 preferably lies in a range from 0.12 mm to 0.22 mm. Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow E2 in FIG. 2B) preferably lies in a range from 0.10 mm to 0.20 mm. Similarly, the height of the part of the second outer electrode 22 that covers the second end surface 12 of the multilayer body 10 preferably lies in a range from 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range from 0.38 mm to 0.42 mm and the width of the multilayer body 10 preferably lies in a range from 0.18 mm to 0.22 mm. In the case where the multilayer coil component 1 according to the embodiment of the present disclosure is the 0402 size, the height of the multilayer body 10 preferably lies in a range from 0.18 mm to 0.22 mm.

In the case where the multilayer coil component 1 according to the embodiment of the present disclosure is the 0402 size, the length of the multilayer coil component 1 preferably lies in a range from 0.38 mm to 0.42 mm. In the case where the multilayer coil component 1 according to the embodiment of the present disclosure is the 0402 size, the width of the multilayer coil component 1 preferably lies in a range from 0.18 mm to 0.22 mm. In the case where the multilayer coil component 1 according to the embodiment of the present disclosure is the 0402 size, the height of the multilayer coil component 1 preferably lies in a range from 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range from 0.08 mm to 0.15 mm. Similarly, the length of the part of the second outer electrode 22 that covers the first main surface 13 of the multilayer body 10 preferably lies in a range from 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range from 0.06 mm to 0.13 mm. Similarly, the height of the part of the second outer electrode 22 that covers the second end surface 12 of the multilayer body 10 preferably lies in a range from 0.06 mm to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range from 0.95 mm to 1.05 mm and the width of the multilayer body 10 preferably lies in a range from 0.45 mm to 0.55 mm. In the case where the multilayer coil component 1 according to the embodiment of the present disclosure is the 1005 size, the height of the multilayer body 10 preferably lies in a range from 0.45 mm to 0.55 mm.

In the case where the multilayer coil component 1 according to the embodiment of the present disclosure is the 1005 size, the length of the multilayer coil component 1 preferably lies in a range from 0.95 mm to 1.05 mm. In the case where the multilayer coil component 1 according to the embodiment of the present disclosure is the 1005 size, the width of the multilayer coil component 1 preferably lies in a range from 0.45 mm to 0.55 mm. In the case where the multilayer coil component 1 according to the embodiment of the present disclosure is the 1005 size, the height of the multilayer coil component 1 preferably lies in a range from 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range from 0.20 mm to 0.38 mm. Similarly, the length of the part of the second outer electrode 22 that covers the first main surface 13 of the multilayer body 10 preferably lies in a range from 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range from 0.15 mm to 0.33 mm. Similarly, the height of the part of the second outer electrode 22 that covers the second end surface 12 of the multilayer body 10 preferably lies in a range from 0.15 mm to 0.33 mm. In this case, stray capacitances arising from the outer electrodes 21 and 22 can be reduced.

Figure 3:
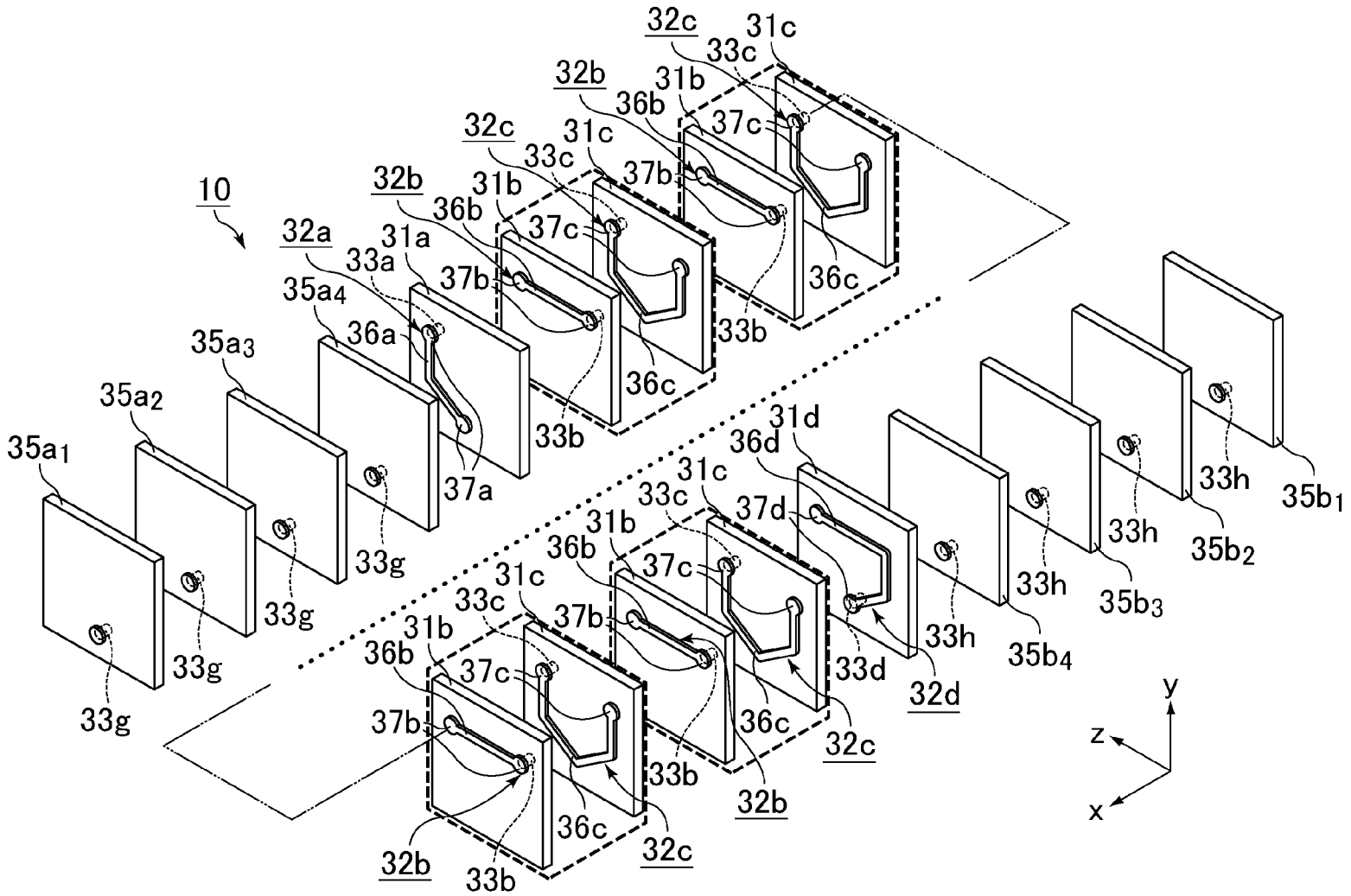
FIG. 3 is an exploded perspective view schematically illustrating an example of a multilayer body of the multilayer coil component.
Figure 4:
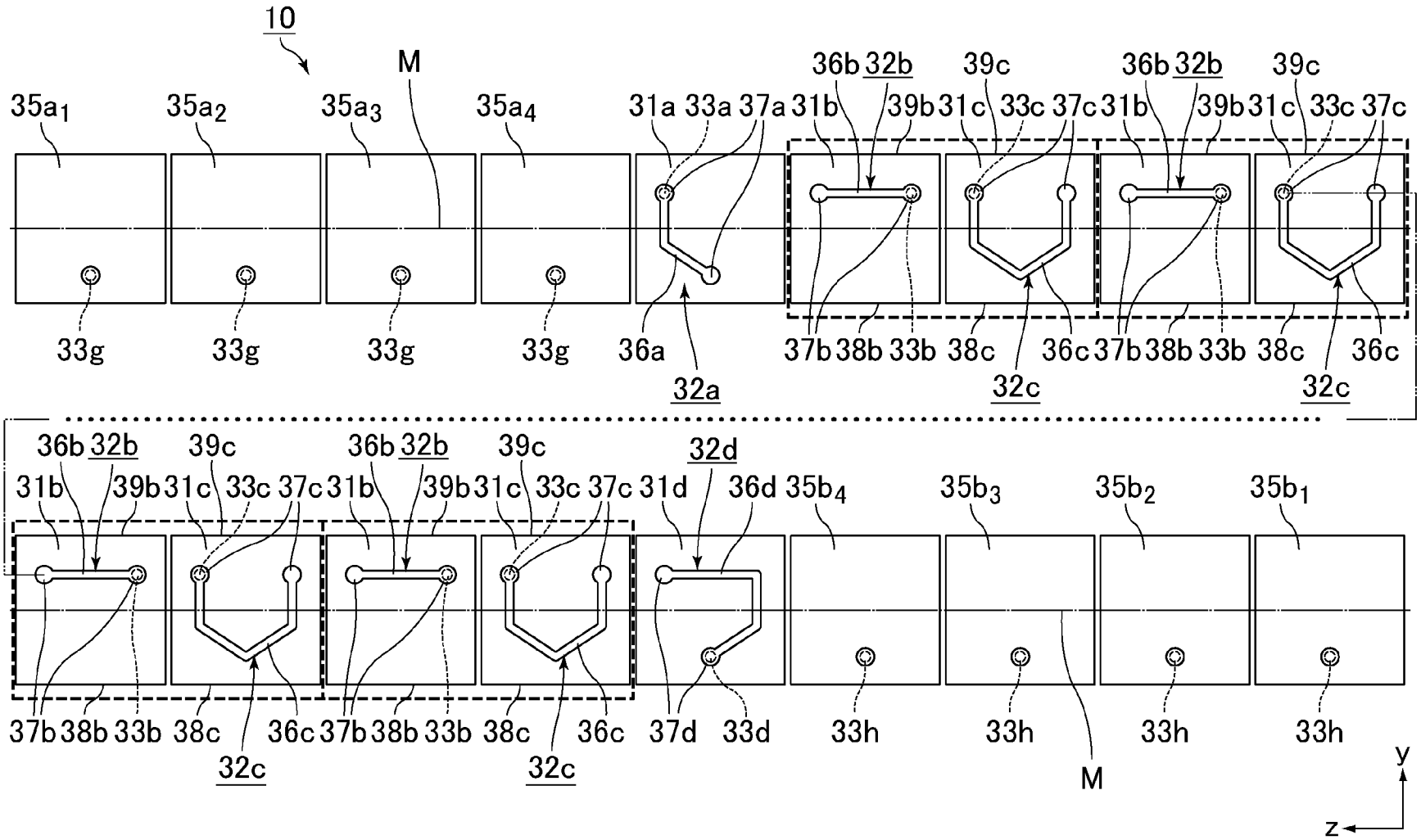
FIG. 4 is an exploded plan view schematically illustrating the example of the multilayer body of the multilayer coil component.

FIG. 3 is an exploded perspective view schematically illustrating an example of the multilayer body 10 of the multilayer coil component 1 illustrated in FIG. 1 and FIG. 4 is an exploded plan view schematically illustrating the example of the multilayer body 10 of the multilayer coil component 1.

As illustrated in FIGS. 3 and 4, the multilayer body 10 includes insulating layers 31*b* and 31*c*, which are for forming one turn of the coil, as insulating layers 31 disposed between the coil conductors. Coil conductors 32*b* and 32*c* and via conductors 33*b* and 33*c* are respectively provided on and in the insulating layers 31*b* and 31*c*. The multilayer body 10 is formed by stacking these insulating layers in the length direction (x direction). The direction in which the plurality of insulating layers of the multilayer body 10 are stacked is called the stacking direction.

The coil conductors 32*b* and 32*c* are respectively provided on main surfaces of the insulating layers 31*b* and 31*c* and are stacked together with the insulating layers 31*b* and 31*c*. The two coil conductors 32*b* and 32*c* together form one turn of the coil and the coil conductors 32*b* and 32*c* are repeatedly stacked as one unit (one turn). In other words, two coil conductors are stacked in order to form one turn of the coil. In FIGS. 3 and 4, a repeating unit that forms one turn is indicated by the region surrounded by a broken line.

The coil conductors used to form one turn of the coil each include a line portion and land portions disposed at the ends of the line portion. Each coil conductor 32*b* includes a line portion 36*b* and two land portions 37*b* and each coil conductor 32*c* includes a line portion 36*c* and two land portions 37*c*. One of the land portions 37*b* of the coil conductor 32*b* is connected a land portion 37*c* of the adjacent coil conductor 32*c* by a via conductor 33*b* or a via conductor 33*c*.

In the multilayer coil component 1, when the repeating shape of the coil conductors 32 is seen in a plan view from the stacking direction, the repeating shape of the coil conductors 32 is a non-circular shape and the distances between the first main surface 13 and the parts of the coil conductors 32 facing the first main surface 13 are not constant. This will be described while referring to FIG. 5.

Figure 5:
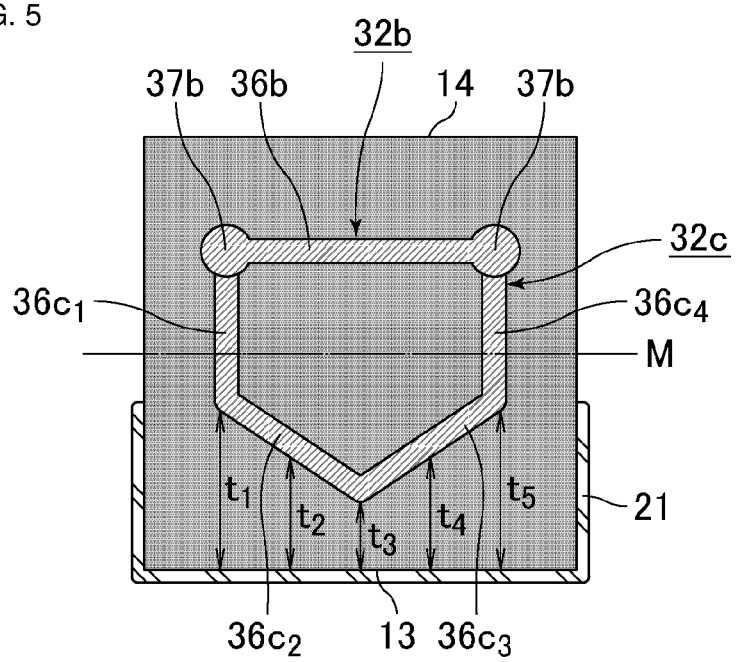
FIG. 5 is a schematic diagram illustrating the repeating shape of the coil conductors in a plan view from the stacking direction.

FIG. 5 is a schematic diagram illustrating the repeating shape of the coil conductors 32 in a plan view from the stacking direction. In FIG. 5, both the coil conductors 32*b* and the coil conductors 32*c* are illustrated in order to illustrate the repeating shape of the coil conductors 32.

The repeating shape of the coil conductors 32 is a pentagonal shape obtained by bending one side of a rectangular shape toward the outside so as to make two sides protrude from the original rectangular shape, and the two sides face the first main surface 13 of the multilayer body 10. The line portion 36*c* of each coil conductor 32*c* is divided into four pieces, namely, line portions $\mathbf{36}c_1$, $\mathbf{36}c_2$, $\mathbf{36}c_3$, and $\mathbf{36}c_4$ and these line portions are regarded as four sides of the pentagonal shape. These four sides and the line portion 36*b* of the coil conductor 32*b* are regarded as the sides of the pentagonal shape and the pentagonal shape illustrated in FIG. 5 is the repeating shape of the coil conductors 32. This shape is a so-called baseball home base shape. In the pentagonal shape illustrated in FIG. 5, the original rectangular shape from which the pentagonal shape is formed is a rectangular shape having a side that is parallel to the line portion 36*b* and directly connects the lower end of the line portion $\mathbf{36}c_1$ and the lower end of the line portion $\mathbf{36}c_4$ to each other.

In the pentagonal shape, the two sides consisting of the line portions $\mathbf{36}c_2$ and $\mathbf{36}c_3$ are the sides that face the first main surface 13 of the multilayer body 10. For example, the distances between these two sides and the first main surface 13 of the multilayer body 10 are indicated by double-headed arrows $t_1$, $t_2$, $t_3$, $t_4$, and $t_5$ in FIG. 5 and the distances are not constant. Specifically, the distances indicated by the double-headed arrows $t_1$ and $t_5$ located further toward the outside of the multilayer body 10 are longer.

Thus, the fact that the distances between the first main surface 13 of the multilayer body 10 and the parts of the coil conductors 32 facing the first main surface 13 of the multilayer body 10 are not constant means that there are parts where the distance between the coil conductors 32 and the first main surface 13 is longer. When there are parts where the distances between the coil conductors 32 and the first main surface 13 are longer, the stray capacitances generated between the coil conductors 32 and the outer electrodes provided on the first main surface 13 are smaller, and therefore radio-frequency characteristics can be improved.

In order to determine whether the distance between part of a coil conductor 32 facing the first main surface 13 of the multilayer body 10 and the first main surface 13 of the multilayer body 10 is constant, as illustrated by the double-headed arrows $t_1$, $t_2$, $t_3$, $t_4$, and $t_5$ in FIG. 5, a plurality of perpendicular lines that are perpendicular to the first main surface 13 may be drawn from the first main surface 13 of the multilayer body toward the coil conductor 32 and the determination may be made based on whether the lengths of the plurality of perpendicular lines are different from each other. As illustrated in FIG. 5, the determination may be made by drawing around five perpendicular lines so as to include the outer sides and the center portion of the multilayer body 10.

The repeating shape of the coil conductors 32 in the multilayer coil component 1 according to the embodiment of the present disclosure is a shape in which the distances between the first main surface 13 and the parts of the coil conductors 32 facing the first main surface 13 are not constant, and provided that the repeating shape is a non-circular shape, the shape is not particularly limited. The repeating shape of the coil conductors 32 is preferably a polygonal shape and is preferably a pentagonal shape obtained by bending one side of a rectangular shape toward the outside so as to make two sides protrude from the original rectangular shape. In the case where the repeating shape of the coil conductors is a polygonal shape, the coil diameter is the diameter of an area-equivalent circle of the polygonal shape and the coil axis is an axis that passes through the center of the polygonal shape and is parallel to the length direction. In addition, the line portions that face the first main surface 13 may have a shape consisting of curved lines rather than straight lines.

In addition, in the multilayer body 10 illustrated in FIGS. 3 and 4, one turn of the coil is formed by two coil conductors and two coil conductors are stacked to form one turn of the coil is two, but the number of coil conductors stacked to form one turn of the coil is not limited to two. For example, coil conductors having a shape equivalent to ¾ of a repeating unit may be connected to each other in the stacking direction. In this case, repeating units equivalent to three turns of the coil would be formed by stacking four coil conductors.

The land portions are preferably disposed in the upper half of the multilayer body 10 on the opposite side from the first main surface 13. The parts that will form the first main surface 13 of the multilayer body 10 are illustrated as sides 38*b* and 38*c* of the insulating layers 31*b* and 31*c* illustrated in FIG. 4. Sides 39*b* and 39*c*, which are on the opposite side from the sides 38*b* and 38*c*, are parts that will form the second main surface 14 of the multilayer body 10. The upper half of the multilayer body 10 on the opposite side from the first main surface 13 refers to the area of the multilayer body 10 that is on the side near the sides 39*b* and 39*c*, which will form the second main surface 14 of the multilayer body 10, using a center line M between the sides 38*b* and 38*c*, which will form the first main surface 13 of the multilayer body 10, and the sides 39*b* and 39*c*, which will form the second main surface 14 of the multilayer body 10, as a reference in FIG. 4. In FIG. 4, it is illustrated that the land portions 37*b* and 37*c* of the coil conductors 32 are disposed in the area near the sides 39*b* and 39*c*, which will form the second main surface 14 of the multilayer body 10. In addition, in FIG. 5 as well, it is illustrated that the land portions 37*b* of the coil conductors 32 are disposed in the upper half of the multilayer body 10 on the opposite side from the first main surface 13 of the multilayer body 10.

In this specification, the land portions that are disposed in the upper half of the multilayer body 10 on the opposite side from the first main surface 13 are land portions for connecting coil conductors that are adjacent to each other in the stacking direction to each other using via conductors. As will be described later, the land portions that are to be connected to the connection conductors are provided in the coil conductor 32*a* provided on the insulating layer 31*a* and the coil conductor 32*d* provided on the insulating layer 31*d*, and the land portions that are to be connected to the connection conductors do not have to be disposed in the upper half of the multilayer body 10 on the opposite side from the first main surface 13.

Figure 6:
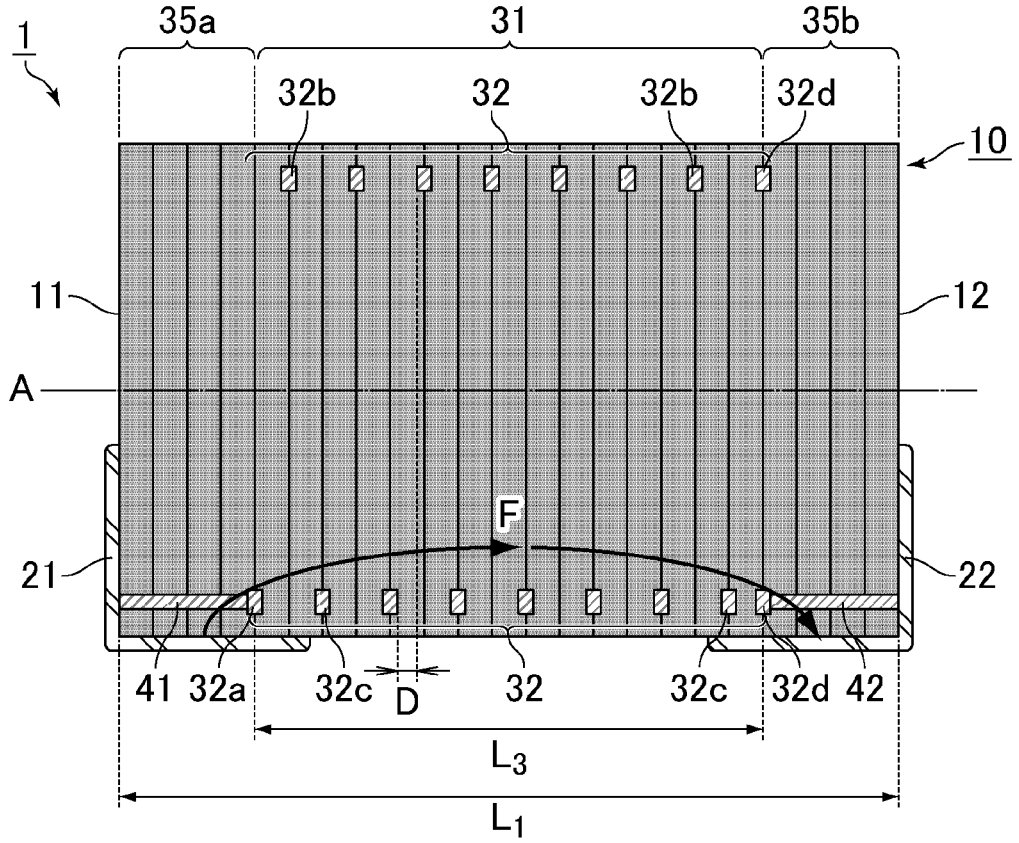
FIG. 6 is a sectional view schematically illustrating an example of the internal structure of the multilayer body of the multilayer coil component.

Since the first main surface 13 of the multilayer body 10 serves as the mounting surface and the first outer electrode 21 and the second outer electrode 22 are provided on the first main surface 13 of the multilayer body 10, an electric field is generated in a region of the multilayer body 10 near the first main surface 13 when power is supplied to the multilayer coil component 1. FIG. 6 is a sectional view schematically illustrating an example of the internal structure of the multilayer body 10 of the multilayer coil component 1 and the position at which the electric field is generated is indicated by an arrow F in FIG. 6. FIG. 6 illustrates insulating layers, coil conductors, connection conductors, and a stacking direction of the multilayer body 10 in a schematic manner, and the actual shapes, connections, and so forth are not depicted with strict accuracy. For example, the coil conductors are connected to each other by via conductors.

Since the land portions of coil conductors have larger surface areas than the line portions of coil conductors, there is a greater effect from stray capacitances and the radio-frequency characteristics are more greatly deteriorated when land portions having a large surface area intersect the electric field. Accordingly, stray capacitances produced due to the effect of the electric field generated in the area of the multilayer body 10 near the first main surface 13 can be reduced by disposing the land portions of the coil conductors in the upper half of the multilayer body 10 on the opposite side from the first main surface 13 and in this way a multilayer coil component having excellent radio-frequency characteristics can be realized.

In addition, as illustrated in FIGS. 3 and 4, when one turn of the coil is formed by two coil conductors, the respective line portions 36*b* and 36*c* of adjacent coil conductors 32*b* and 32*c* do not face each other via an insulating layer. Therefore, a stray capacitance generated between the coil conductors is small and a multilayer coil component that has excellent radio-frequency characteristics can be realized.

In the multilayer coil component 1, when the repeating shape of the coil conductors 32 is seen in a plan view from the stacking direction, the repeating shape of the coil conductors 32 is a non-circular shape and the distances between the first main surface 13 and the parts of the coil conductors 32 facing the first main surface 13 and are not constant. Therefore, both the mountability and the radio-frequency characteristics are excellent. The radio-frequency characteristics are particularly excellent in a high-frequency band (in particular, band from 30 GHz to 80 GHz). Specifically, the transmission coefficient S21 at 40 GHz preferably lies in a range from −1 dB to 0 dB, the transmission coefficient S21 at 50 GHz preferably lies in a range from −2 dB to 0 dB, and the transmission coefficient at 60 GHz preferably lies in a range from −4 dB to 0 dB. The transmission coefficient S21 is obtained from the ratio of the power of a transmitted signal to the power of an input signal. The transmission coefficient S21 is basically a dimensionless quantity, but is usually expressed in dB using the common logarithm. When the above conditions are satisfied, for example, the multilayer coil component 1 can be suitably used in a bias tee circuit inside an optical communication circuit, for example.

In addition, in the case where the number of coil conductors 32 that are stacked to form one turn of the coil is two and the land portions are disposed in the upper half of the multilayer body 10 on the opposite side from the first main surface 13, a multilayer coil component having even more excellent radio-frequency characteristics can be realized.

Furthermore, the number of stacked coil conductors 32 preferably lies in a range from 40 to 60. If the number of stacked coil conductors 32 is less than 40, the stray capacitances will become larger and the transmission coefficient S21 will decrease. If the number of stacked coil conductors 32 exceeds 60, the direct current resistance (Rdc) will become large. The transmission coefficient S21 at 60 GHz can be improved by making the number of stacked coil conductors 32 lie in a range from 40 to 60. The number of stacked coil conductors 32 includes both the number of stacked coil conductors 32 for forming single turns of the coil (coil conductors 32*b* and coil conductors 32*c*) and the number of stacked coil conductors 32 for realizing positional adjustment (coil conductor 32*a* and coil conductor 32*d*).

Furthermore, a distance D between adjacent coil conductors 32 in the stacking direction (refer to FIG. 6) preferably lies in a range from 3 μm to 10 μm. In this way, the number of turns of the coil can be increased. As a result, the impedance is increased and the transmission coefficient S21 in a high-frequency band is also increased. The distance D between coil conductors 32 that are adjacent to each other in the stacking direction means the shortest distance in the stacking direction between coil conductors 32 that are connected to each other by a via conductor. Therefore, the distance D between coil conductors 32 that are adjacent to each other in the stacking direction and the distance between coil conductors 32 that are involved in generation of stray capacitances are not necessarily the same.

Furthermore, the length of the region in which the coil conductors 32 are arranged in the stacking direction preferably lies in a range from 85% to 95% the length of the multilayer body 10. Here, a length $L_3$ of the region in which the coil conductors 32 are arranged in the stacking direction (refer to FIG. 6) is the distance in the stacking direction from the coil conductor 32 that is connected to the first outer electrode 21 via a first connection conductor 41 to the coil conductor 32 that is connected to the second outer electrode 22 via a second connection conductor 42 (including the thicknesses of the coil conductors 32). In the case where the length $L_3$ of the region in which the coil conductors 32 are arranged is smaller than 85% of the length $L_1$ of the multilayer body 10, the radio-frequency characteristics of the multilayer coil component 1 may deteriorate due to the electrostatic capacitance of the coil becoming larger. In the case where the length $L_3$ of the region in which the coil conductors 32 are arranged is greater than 95% of the length $L_1$ of the multilayer body 10, the radio-frequency characteristics of the multilayer coil component 1 may deteriorate due to the stray capacitances generated between the coil and the first outer electrode 21 and the second outer electrode 22 becoming larger. Therefore, the radio-frequency characteristics of the multilayer coil component 1 are further improved when the length $L_3$ of the region in which coil conductors 32 are arranged in the multilayer coil component 1 lies within the above-described range.

Next, other parts of the multilayer body 10 will be described while referring once again to FIGS. 3 and 4. The multilayer body 10 includes insulating layers 35$a_1$, 35$a_2$, 35$a_3$, and 35$a_4$ as insulating layers 35*a* located around the first connection conductor 41 and insulating layers 35$b_1$, 35$b_2$, 35$b_3$, and 35$b_4$ as insulating layers 35*b* located around the second connection conductor 42.

Via conductors 33*g* are provided in the insulating layers 35$a_1$, 35$a_2$, 35$a_3$, and 35$a_4$. The via conductors 33*g* are connected together and form the first connection conductor 41. Via conductors 33*h* are provided in the insulating layers 35$b_1$, 35$b_2$, 35$b_3$, and 35$b_4$. The via conductors 33*h* are connected together and form the second connection conductor 42. The via conductors 33*g* forming the first connection conductor 41 and the via conductors 33*h* forming the second connection conductor 42 are both located on the first main surface 13 side (mounting surface side) of the multilayer body 10.

The insulating layer 31*a* is provided between the insulating layer 35$a_4$ and the insulating layer 31*b* and the coil conductor 32*a* and the via conductor 33*a*, which are for connecting the via conductors 33*g*, which form the first connection conductor 41, and the coil conductor 32*b* to each other, are provided on and in the insulating layer 31*a*. The coil conductor 32*a* includes a line portion 36*a* located between two land portions 37*a* and is connected between one land portion 37*b*, which is connected to the via conductors 33*g* disposed on the first main surface 13 side of the multilayer body 10, and the other land portion 37*b*, which is disposed on the second main surface 14 side of the multilayer body 10 and is connected to the land portion 37*b* of the coil conductor 32*b* by the via conductor 33*a*.

Similarly, the insulating layer 31*d* is provided between the insulating layer 35$b_4$ and the insulating layer 31*c* and the coil conductor 32*d* and a via conductor 33*d*, which are for connecting the via conductors 33*h* that form the second connection conductor 42 and the coil conductor 32*c* to each other, are provided on and in the insulating layer 31*d*. The coil conductor 32*d* includes a line portion 36*d* located between two land portion 37*d* and is connected between one land portion 37*d*, which is disposed on the second main surface 14 side of the multilayer body 10 and is connected to the land portion 37*c* of the coil conductor 32*c* by the via conductor 33*c*, and the other land portion 37*d*, which connected to the via conductors 33*h* disposed on the first main surface 13 side of the multilayer body 10.

The via conductors 33*a*, 33*b*, 33*c*, and 33*d* are provided so as to respectively penetrate through the insulating layers 31*a*, 31*b*, 31*c*, and 31*d* in the stacking direction (x direction in FIG. 3).

The thus-configured insulating layers 31*a*, 31*b*, 31*c*, and 31*d* are stacked on top of one another in the x direction as illustrated in FIG. 3. Thus, the coil conductors 32*a*, 32*b*, 32*c*, and 32*d* are electrically connected to each other by the via conductors 33*a*, 33*b*, 33*c*, and 33*d*. As a result, a solenoid coil having a coil axis that extends in the x direction is formed inside the multilayer body 10.

The first connection conductor 41 and the second connection conductor 42 are exposed at the two end surfaces 11 and 12 of the multilayer body 10. The first connection conductor 41 is connected between the first outer electrode 21 and the coil conductor 32*a* that faces the first outer electrode 21 inside the multilayer body 10. In addition, the second connection conductor 42 is connected between the second outer electrode 22 and the coil conductor 32*d* that faces the second outer electrode 22.

As illustrated in FIG. 6, the multilayer coil component 1 includes the multilayer body 10 in which a plurality of insulating layers 31 are stacked on top of one another and that has a coil built into the inside thereof. The coil is formed by electrically connecting a plurality of coil conductors 32, which are stacked together with the insulating layers 31, to one another. The stacking direction of the multilayer body 10 and the axial direction of the coil (coil axis A illustrated in FIG. 5) are parallel to the first main surface 13, which is the mounting surface.

In the multilayer coil component 1 illustrated in FIG. 6, the first outer electrode 21 and the coil conductor 32*a* that faces the first outer electrode 21 are connected to each other by the first connection conductor 41 in a straight line and the second outer electrode 22 and the coil conductor 32*d* that faces the second outer electrode 22 are connected to each other by the second connection conductor 42 in a straight line. The first connection conductor 41 and the second connection conductor 42 are connected to the respective coil conductors 32*a* and 32*d* at the parts of the coil conductors 32*a* and 32*d* that are closest to the first main surface 13, which is the mounting surface. The first connection conductor 41 and the second connection conductor 42 overlap the coil conductors 32 in a plan view from the stacking direction and are positioned closer to the first main surface 13, which is the mounting surface, than the coil axis. Since the first connection conductor 41 and the second connection conductor 42 are both connected to the coil conductors 32*a* and 32*d* at the parts of the coil conductors 32*a* and 32*d* that are closest to the mounting surface, the outer electrodes 21 and 22*c* an be reduced in size and the radio-frequency characteristics can be improved.

In the case where the repeating shape of the coil conductors 32 is a substantially polygonal shape, the coil diameter is the diameter of an area-equivalent circle of the polygonal shape. In the case where the multilayer coil component 1 according to the embodiment of the present disclosure is the 0603 size, the coil diameter preferably lies in a range from 50 μm to 100 μm.

In the case where the multilayer coil component 1 according to the embodiment of the present disclosure is the 0402 size, the coil diameter preferably lies in a range from 30 μm to 70 μm.

In the case where the multilayer coil component 1 according to the embodiment of the present disclosure is the 1005 size, the coil diameter preferably lies in a range from 80 μm to 170 μm.

The line width of the line portions in a plan view from the stacking direction is not particularly limited but is preferably in a range from 10% to 30% of the width of the multilayer body 10. When the line width of the line portions is less than 10% of the width of the multilayer body 10, the direct-current resistance Rdc may become large. On the other hand, when the line width of the line portions exceeds 30% of the width of the multilayer body 10, the electrostatic capacitance of the coil may become large and the radio-frequency characteristics may be degraded.

In the case where the multilayer coil component 1 according to the embodiment of the present disclosure is the 0603 size, the line width of the line portions preferably lies in a range from 30 μm to 90 μm and more preferably lies in a range from 30 μm to 70 μm.

In the case where the multilayer coil component 1 according to the embodiment of the present disclosure is the 0402 size, the line width of the line portions preferably lies in a range from 20 μm to 60 μm and more preferably lies in a range from 20 μm to 50 μm.

In the case where the multilayer coil component 1 according to the embodiment of the present disclosure is the 1005 size, the line width of the line portions preferably lies in a range from 50 μm to 150 μm and more preferably lies in a range from 50 μm to 120 μm.

The coil diameter in a plan view from the stacking direction preferably lies in a range from 15% to 40% of the width of the multilayer body 10.

It is preferable that the first connection conductor 41 and the second connection conductor 42 be provided inside the multilayer body 10 of the multilayer coil component 1. The shapes of the first connection conductor 41 and the second connection conductor 42 are not particularly limited, but it is preferable that the first connection conductor 41 and the second connection conductor 42 be each connected in a straight line between an outer electrode and a coil conductor. By connecting the first connection conductor 41 and the second connection conductor 42 from the coil conductors 32 to the outer electrodes 21 and 22 in straight lines, lead out parts can be simplified and the radio-frequency characteristics can be improved.

In the case where the multilayer coil component 1 according to the embodiment of the present disclosure is the 0603 size, the lengths of the first connection conductor 41 and the second connection conductor 42 preferably lie in a range from 15 μm to 45 μm and more preferably lie in a range from 15 μm to 30 μm.

In the case where the multilayer coil component 1 according to the embodiment of the present disclosure is the 0402 size, the lengths of the first connection conductor 41 and the second connection conductor 42 preferably lie in a range from 10 μm to 30 μm and more preferably lie in a range from 10 μm to 25 μm.

In the case where the multilayer coil component 1 according to the embodiment of the present disclosure is the 1005 size, the lengths of the first connection conductor 41 and the second connection conductor 42 preferably lie in a range from 25 μm to 75 μm and more preferably lie in a range from 25 μm to 50 μm.

It is preferable that the first connection conductor 41 and the second connection conductor 42 overlap the coil conductors 32 in a plan view from the stacking direction and be positioned closer to the mounting surface than the coil axis. The coil axis is an axis that passes through the center of the repeating shape formed by the coil conductors 32 and is parallel to the length direction.

Provided that via conductors forming a connection conductor overlap in a plan view from the stacking direction, the via conductors forming the connection conductor do not have to be precisely aligned in a straight line.

The width of the first connection conductor 41 and the width of the second connection conductor 42 preferably each lie in a range from 8% to 20% of the width of the multilayer body 10. The "width of the connection conductor" refers to the width of the narrowest part of the connection conductor. That is, when a connection conductor includes a land, the shape of the connection conductor is the shape obtained by removing the land.

In the case where the multilayer coil component 1 according to the embodiment of the present disclosure is the 0603 size, the widths of the connection conductors 41 and 42 preferably lie in a range from 30 μm to 60 μm.

In the case where the multilayer coil component 1 according to the embodiment of the present disclosure is the 0402 size, the widths of the connection conductors 41 and 42 preferably lie in a range from 20 μm to 40 μm.

In the case where the multilayer coil component 1 according to the embodiment of the present disclosure is the 1005 size, the widths of the connection conductors 41 and 42 preferably lie in a range from 40 μm to 100 μm.

In the multilayer coil component 1 according to the embodiment of the present disclosure, the lengths of the first connection conductor 41 and the second connection conductor 42 preferably lie in a range from 2.5% to 7.5% of the length of the multilayer body 10 and more preferably lie in a range from 2.5% to 5.0% of the length of the multilayer body 10.

In the multilayer coil component 1 according to the embodiment of the present disclosure, there may be two or more of the first connection conductor and the second connection conductor. A case where there are two or more connection conductors indicates a state where a part of an outer electrode covering an end surface and the coil conductor facing that outer electrode are connected to each other in at least two places by the connection conductors.

Hereafter, an example of a method of manufacturing the multilayer coil component 1 according to the embodiment of the present disclosure will be described.

First, ceramic green sheets, which will form the insulating layers, are manufactured. For example, an organic binder such as a polyvinyl butyral resin, an organic solvent such as ethanol or toluene, and a dispersant are added to a ferrite material and the resulting mixture is kneaded to form a slurry. After that, ceramic green sheets having a thickness of around 12 μm are obtained using a method such as a doctor blade technique.

As a ferrite material, for example, iron, nickel, zinc and copper oxide raw materials are mixed together and calcined at 800° C. for one hour, pulverized using a ball mill, and dried, and a Ni—Zn—Cu ferrite raw material (oxide mixed powder) having an average particle diameter of about 2 μm can be obtained.

As a ceramic green sheet material, which will form the insulating layers, for example, a magnetic material such as a ferrite material, a nonmagnetic material such as a glass ceramic material, or a mixed material obtained by mixing a magnetic material and a nonmagnetic material can be used. When manufacturing ceramic green sheets using a ferrite material, in order to obtain a high L value (inductance), it is preferable to use a ferrite material having a composition consisting of $Fe_2O_3$ at 40 mol % to 49.5 mol %, ZnO at 5 mol % to 35 mol %, CuO at 4 mol % to 12 mol %, and the remainder consisting of NiO and trace amounts of additives (including inevitable impurities).

Via holes having a diameter of around 20 μm to 30 μm are formed by subjecting the manufactured ceramic green sheets to prescribed laser processing. Using a Ag paste on specific sheets having via holes, coil sheets are formed by filling the via holes and screen-printing and drying prescribed coil-conductor conductor patterns having a thickness of around 11 μm. Conductor patterns corresponding to the coil conductors 32*a*, 32*b*, 32*c*, and 32*d* in FIG. 4 are printed as the coil-conductor conductor patterns.

The coil sheets are stacked in a prescribed order so that a coil having a coil axis in a direction parallel to the mounting surface is formed in the multilayer body after division into individual components. In addition, via sheets, in which via conductors that will form the connection conductors are formed, are stacked above and below the coil sheets.

The multilayer body is subjected to thermal pressure bonding in order to obtain a pressure-bonded body, and then the pressure-bonded body is cut into pieces of a predetermined chip size to obtain individual chips. The divided chips may be subjected to barrel polishing in order to round the corner portions and edge portions thereof.

Binder removal and firing is performed at a predetermined temperature and for a predetermined period of time, and fired bodies (multilayer bodies) having a built-in coil are obtained.

Each multilayer body is dipped at an angle in a tank in which Ag paste has been spread to a predetermined thickness and then baked to form a base electrode of an outer electrode on four surfaces (a main surface, an end surface, and both side surfaces) of the multilayer body. In the above-described method, the base electrode can be formed in one go in contrast to the case where the base electrode is formed separately on the main surface and the end surface of the multilayer body in two steps.

Formation of the outer electrodes is completed by sequentially forming a Ni film and a Sn film having predetermined thicknesses on the base electrodes by performing plating. A multilayer coil component according to an embodiment of the present disclosure can be manufactured as described above.

EXAMPLES

Hereafter, an example that illustrates the multilayer coil component 1 according to the embodiment of the present disclosure in a more specific manner will be described. The present disclosure is not limited to just the following example.

Manufacture of Test Pieces

Example 1

1. A ferrite material (calcined powder) having a prescribed composition was prepared.

2. A magnetic slurry was manufactured by adding an organic binder (polyvinyl butyral resin) and organic solvents (ethanol and toluene) to the calcined powder and putting the mixture into a pot mill along with PSZ balls and then sufficiently mixing and pulverizing the mixture in a wet state.

3. The magnetic slurry was molded into a sheet shape using a doctor blade method and then punched into rectangular shapes, thereby producing a plurality of ceramic green sheets having a thickness of 15 μm.

4. An inner-conductor conductive paste containing Ag powder and an organic vehicle was prepared.

5. Via Sheet Manufacture

Via holes were formed by irradiating prescribed locations on the ceramic green sheets with a laser. Via conductors were formed by filling the via holes with a conductive paste and land portions were formed by performing screen printing with a conductive paste in circular shapes around the peripheries of the via conductors.

6. Coil Sheet Manufacture

The coil sheets were obtained by forming via conductors by forming via holes in prescribed locations on the ceramic green sheets and filling the via holes with a conductive paste, and then forming coil conductors by performing printing to form land portions and line portions.

7. Predetermined numbers of these sheets were stacked in the order illustrated in FIG. 3 and the resulting body was then heated, pressed, and cut into individual pieces using a dicer, and in this way, multilayer molded bodies were manufactured.

8. (Fired) multilayer bodies were manufactured by placing the multilayer molded bodies in a firing furnace, subjecting the bodies to a binder removal treatment under an air atmosphere at a temperature of 500° C. and then firing the bodies at a temperature of 900° C. The dimensions of thirty of the obtained multilayer bodies were measured using a micrometer, and the following average values were determined: L=0.60 mm, W=0.30 mm, and T=0.30 mm.

9. An outer-electrode conductive paste containing Ag powder and glass frit was poured into a coating film forming tank in order to form a coating film of a predetermined thickness. The places where the outer electrodes are to be formed on each multilayer body were immersed in the coating film.

10. After the immersion, each multilayer body was baked at a temperature of around 800° C. and in this way the base electrodes of the outer electrodes were formed.

11. Formation of the outer electrodes was completed by sequentially forming a Ni film and a Sn film on the base electrodes by performing electroplating. Test pieces of example 1 having the internal structure of the multilayer body 10 illustrated in FIG. 3 were manufactured as described above.

Figure 7A:
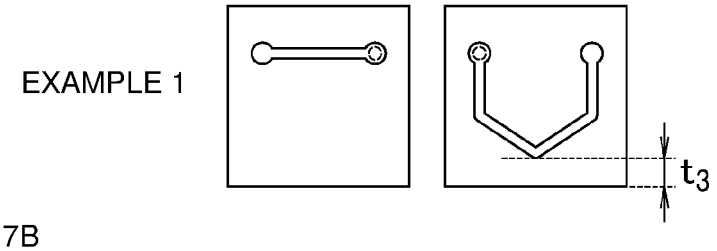
FIG. 7A is a schematic diagram illustrating the repeating shape of coil conductors of a test piece of example 1 and FIG. 7B is a schematic diagram illustrating the repeating shape of coil conductors of a test piece of comparative example 1.
Figure 7B:
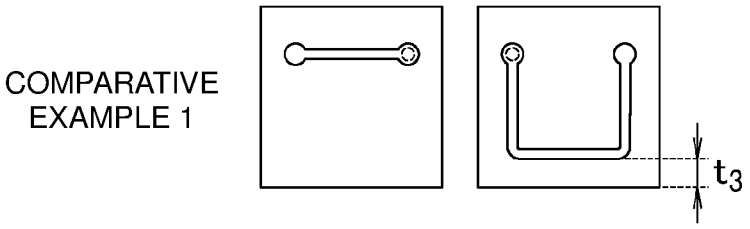

FIG. 7A is a schematic diagram illustrating the repeating shape of coil conductors of a test piece of example 1 and FIG. 7B is a schematic diagram illustrating the repeating shape of coil conductors of a test piece of comparative example 1. The repeating shape of the coil conductors of the test piece of example 1 is a pentagonal shape obtained by bending one side of a rectangular shape toward the outside so as to make two sides protrude from the original rectangular shape and the two sides face the first main surface 13 of the multilayer body 10 as illustrated in FIG. 7A. This shape is a shape in which the distances between the first main surface 13 and the parts of the coil conductors that face the first main surface 13 are not constant.

Comparative Example 1

As illustrated in FIG. 7B, test pieces of comparative example 1 were manufactured by manufacturing multilayer molded bodies by changing the shape of a coil conductor corresponding to the coil conductor 32*c* illustrated in FIG. 3 and manufacturing and then stacking coil sheets in which the repeating shape of the coil conductors is a four-sided shape. The repeating shape of the coil conductors of the test pieces of comparative example 1 is a four-sided shape and is a shape in which the distance between the first main surface and the parts of the coil conductors facing the first main surface is constant. The distance between the first main surface and the parts of the coil conductors facing the first main surface is a constant distance as indicated by a double-headed arrow $t_3$ in FIG. 7B. The distance indicated by the double-headed arrow $t_3$ is identical to a distance $t_3$ of a part where the distance between the first main surface and the coil conductors facing the first main surface is shortest in the repeating shape of the coil conductors of the test piece of example 1.

Measurement of Transmission Coefficient S21

Figure 8:
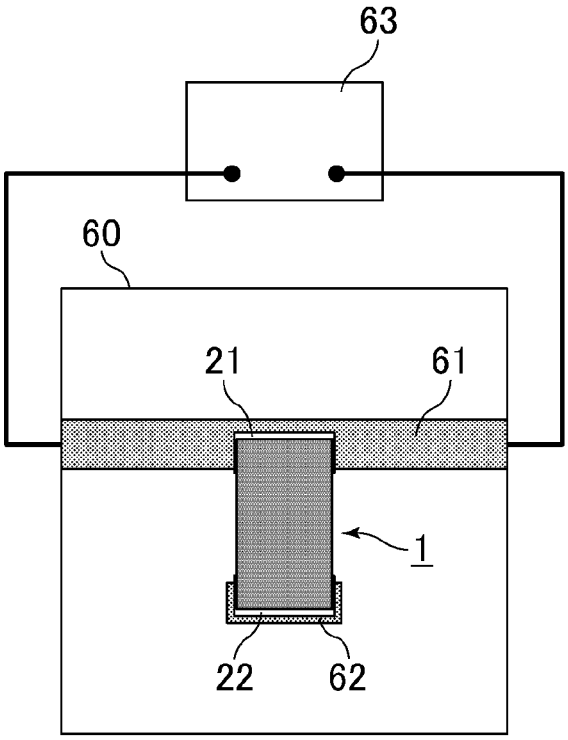
FIG. 8 is a diagram schematically illustrating a method of measuring the transmission coefficient S21.
Figure 9:
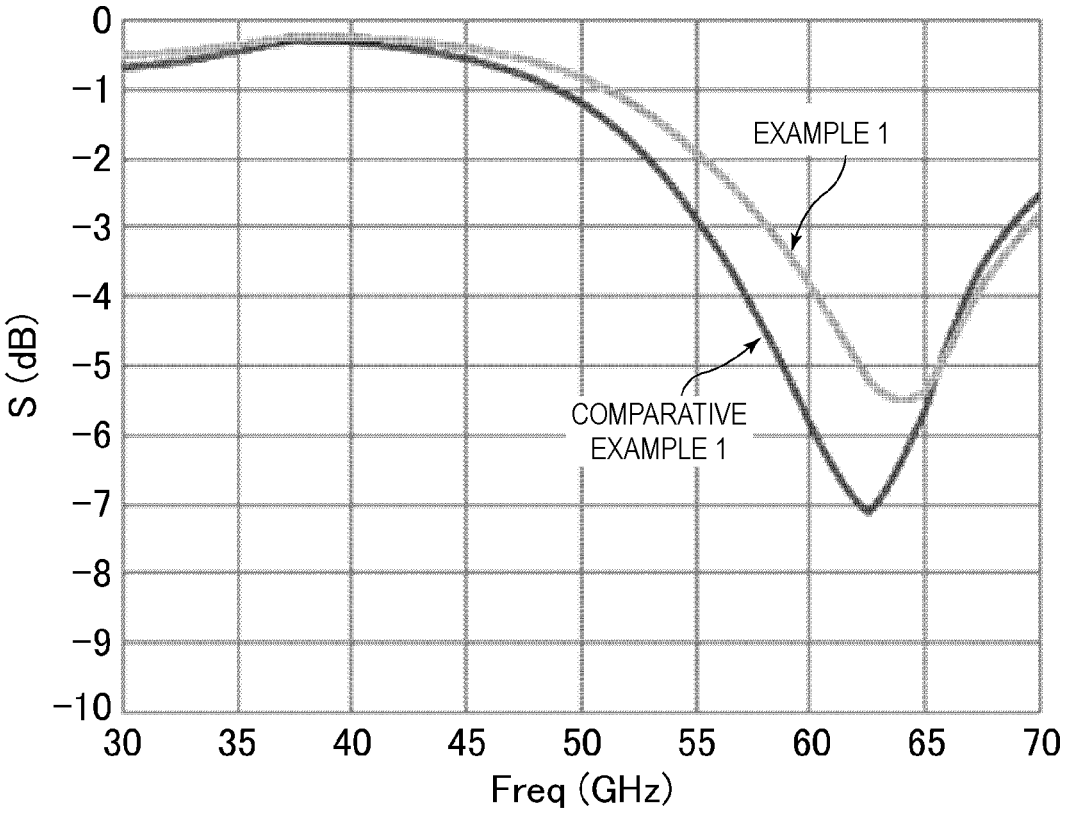
FIG. 9 is a graph illustrating the transmission coefficient S21 in example 1 and comparative example 1.

FIG. 8 is a diagram schematically illustrating a method of measuring the transmission coefficient S21. In addition, FIG. 9 is a graph illustrating the transmission coefficient S21 in example 1 and comparative example 1. As illustrated in FIG. 8, a test piece (multilayer coil component 1) was soldered to a measurement jig 60 that was provided with a signal path 61 and a ground conductor 62. The first outer electrode 21 of the multilayer coil component 1 was connected to the signal path 61 and the second outer electrode 22 of the multilayer coil component 1 was connected to the ground conductor 62.

The transmission coefficient S21 was measured by obtaining the power of an input signal to the test piece and the power of a transmitted signal from the test piece and changing the signal frequency using a network analyzer 63. The two ends of the signal path 61 are connected to the network analyzer 63. The transmission coefficient S21 indicates that the closer the transmission coefficient S21 is to 0 dB, the smaller the loss is.

It is clear from FIG. 9 that the resonant frequency is 64.0 GHz in example 1, the resonant frequency is 62.5 GHz in comparative example 1, and in the case of the configuration of example 1, the resonant frequency is shifted toward the high-frequency side, and better radio-frequency characteristics are realized.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers a portion of the first end surface and a portion of the first main surface, the second outer electrode extends along and covers a portion of the second end surface and a portion of the first main surface, the first main surface is a mounting surface, a stacking direction of the multilayer body and an axial direction of the coil are parallel to the first main surface, in a plan view of a repeating shape of the coil conductors from the stacking direction, the repeating shape of the coil conductors is a non-circular shape, and distances between the first main surface and portions of the coil conductors that face the first main surface vary, the coil conductors each include a line portion and a land portion arranged at an end of the line portion, and the land portions of coil conductors that are adjacent to each other in the stacking direction are connected to each other through via conductors, and in a plan view from the width direction, the land portions are disposed in an upper half of the multilayer body on the opposite side from the first main surface.

2. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers a portion of the first end surface and a portion of the first main surface, the second outer electrode extends along and covers a portion of the second end surface and a portion of the first main surface, the first main surface is a mounting surface, a stacking direction of the multilayer body and an axial direction of the coil are parallel to the first main surface, in a plan view of a repeating shape of the coil conductors from the stacking direction, the repeating shape of the coil conductors is a non-circular shape, and distances between the first main surface and portions of the coil conductors that face the first main surface vary, and a number of stacked coil conductors is in a range from 40 to 60.

3. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers a portion of the first end surface and a portion of the first main surface, the second outer electrode extends along and covers a portion of the second end surface and a portion of the first main surface, the first main surface is a mounting surface, a stacking direction of the multilayer body and an axial direction of the coil are parallel to the first main surface, in a plan view of a repeating shape of the coil conductors from the stacking direction, the repeating shape of the coil conductors is a non-circular shape, and distances between the first main surface and portions of the coil conductors that face the first main surface vary, and a length of a region in which the coil conductors are arranged in the stacking direction is in a range from 85% to 95% of a length of the multilayer body.

4. The multilayer coil component according to claim 3, wherein in a plan view of the repeating shape of the coil conductors from the stacking direction, the repeating shape of the coil conductors is a pentagonal shape obtained by bending one side of a rectangular shape toward the outside to make two sides protrude from the original rectangular shape, and the two sides face the first main surface of the multilayer body.

5. The multilayer coil component according to claim 3, wherein a number of coil conductors that are stacked in order to define one turn of the coil is two.

6. The multilayer coil component according to claim 3, wherein the coil conductors each include a line portion and a land portion arranged at an end of the line portion, and the land portions of coil conductors that are adjacent to each other in the stacking direction are connected to each other through via conductors, and in a plan view from the width direction, the land portions are disposed in an upper half of the multilayer body on the opposite side from the first main surface.

7. The multilayer coil component according to claim 3, wherein a number of stacked coil conductors is in a range from 40 to 60.

8. The multilayer coil component according to claim 3, wherein a distance between coil conductors that are adjacent to each other in the stacking direction is in a range from 3 μm to 10 μm.

9. The multilayer coil component according to claim 4, wherein a number of coil conductors that are stacked in order to define one turn of the coil is two.

10. The multilayer coil component according to claim 4, wherein the coil conductors each include a line portion and a land portion arranged at an end of the line portion, and the land portions of coil conductors that are adjacent to each other in the stacking direction are connected to each other through via conductors, and in a plan view from the width direction, the land portions are disposed in an upper half of the multilayer body on the opposite side from the first main surface.

11. The multilayer coil component according to claim 5, wherein the coil conductors each include a line portion and a land portion arranged at an end of the line portion, and the land portions of coil conductors that are adjacent to each other in the stacking direction are connected to each other through via conductors, and in a plan view from the width direction, the land portions are disposed in an upper half of the multilayer body on the opposite side from the first main surface.

12. The multilayer coil component according to claim 4, wherein a number of stacked coil conductors is in a range from 40 to 60.

13. The multilayer coil component according to claim 5, wherein a number of stacked coil conductors is in a range from 40 to 60.

14. The multilayer coil component according to claim 6, wherein a number of stacked coil conductors is in a range from 40 to 60.

15. The multilayer coil component according to claim 4, wherein a distance between coil conductors that are adjacent to each other in the stacking direction is in a range from 3 μm to 10 μm.

16. The multilayer coil component according to claim 5, wherein a distance between coil conductors that are adjacent to each other in the stacking direction is in a range from 3 μm to 10 μm.

17. The multilayer coil component according to claim 6, wherein a distance between coil conductors that are adjacent to each other in the stacking direction is in a range from 3 μm to 10 μm.

18. The multilayer coil component according to claim 7, wherein a distance between coil conductors that are adjacent to each other in the stacking direction is in a range from 3 μm to 10 μm.

* * * * *